US005735681A

United States Patent [19]

Cheng

[11] Patent Number: 5,735,681

[45] Date of Patent: Apr. 7, 1998

[54] ULTRALEAN LOW SWIRL BURNER

[75] Inventor: Robert K. Cheng, Kensington, Calif.

[73] Assignee: The Regents, University of California, Oakland, Calif.

[21] Appl. No.: 33,878

[22] Filed: Mar. 19, 1993

[51] Int. Cl.[6] ..... F23M 3/04

[52] U.S. Cl. ..... 431/10; 431/185; 122/14; 110/260

[58] Field of Search ..... 431/9, 8, 10, 184, 431/185; 122/14; 110/260–262

[56] References Cited

U.S. PATENT DOCUMENTS

| | | | |
|---|---|---|---|
| 4,021,188 | 5/1977 | Yamagishi et al. | 431/9 X |
| 4,297,093 | 10/1981 | Morimoto et al. | 431/10 |
| 5,092,762 | 3/1992 | Yanig | 431/184 |
| 5,127,821 | 7/1992 | Keller | 431/10 |

*Primary Examiner*—Henry A. Bennett
*Assistant Examiner*—Susanne C. Tinker
*Attorney, Agent, or Firm*—Pepi Ross; Paul R. Martin

[57] ABSTRACT

A novel burner and burner method has been invented which burns an ultra lean premixed fuel-air mixture with a stable flame. The inventive burning method results in efficient burning and much lower emissions of pollutants such as oxides of nitrogen than previous burners and burning methods. The inventive method imparts weak swirl (swirl numbers of between about 0.01 to 3.0) on a fuel-air flow stream. The swirl, too small to cause recirculation, causes an annulus region immediately inside the perimeter of the fuel-air flow to rotate in a plane normal to the axial flow. The rotation in turn causes the diameter of the fuel-air flow to increase with concomitant decrease in axial flow velocity. The flame stabilizes where the fuel-air mixture velocity equals the rate of burning resulting in a stable, turbulent flame.

47 Claims, 7 Drawing Sheets

ULTRALEAN LOW SWIRL BURNER

This invention was made with U.S. Government support under Contract No. DE-AC03-76SF00098 between the U.S. Department of Energy and the University of California for the operation of Lawrence Berkeley Laboratory. The U.S. Government may have certain rights in this invention.

BACKGROUND OF THE INVENTION

1. Field of the Invention

This invention relates generally to gas burners, and more particularly to burners using fuel that is premixed with air or other oxidizers. Further this invention relates to the flame stabilization of gas burners and to burners that minimize the formation of oxides of nitrogen ($NO_x$). The present invention is directed at energy efficient burners with minimized environmental impact. Stabilized flame burners are used for many heating and power generation purposes, including turbines, furnaces, and water heaters.

2. Description of Related Art

To be practical a burner must be designed to burn with a stable flame. This can be accomplished in many ways by balancing several different parameters, such as fuel-mixture speed, fuel richness, flame temperature, flame speed, and recirculation (definition, infra.) configuration. A flame burns steadily when the fuel mixture flows at a speed equal to the flame speed. However conventional burner configurations are only stable in a narrow range of operating conditions because minor perturbations in the burner environment can lead to flashback or blowout (see definitions, infra.). For example, a minor decrease in the fuel-air mixture flow-rate may cause flashback and a minor increase in the fuel-air mixture flow-rate may cause blowout. To maintain a stable flame it is necessary to ensure conditions in which there is always a region where the fuel-air mixture flow-rate equals the flame speed. An important aspect of burner design is to use a mechanical configuration and fuel mixture that creates a stable flame.

Conventionally, stable flames are achieved by creating the following set of conditions: The fuel flow is maintained at a higher velocity than the flame speed. This condition prevents flashback but could also result in blowout. To prevent blowout and to "anchor" the flame, a mechanical obstruction is placed in the path of the fuel mixture flow. The obstruction can be any of several designs, including a blunt body, a "v" gutter, a bar, a ring attached to the rim of the flow nozzle, or a stagnation plate. Any of these interrupts the flow, causing zero axial flow immediately upstream of the blockage and turbulent flow immediately downstream of the block. As the fuel flows around the block, it becomes turbulent and several regions of reverse flow are created, where the fuel flow is actually circling back in a direction opposite to the original flow ("recirculation"). In most conventional burners the fuel is not mixed with air prior to entering the flame zone, but the recirculating turbulent flow around the blockage entrains air into the fuel stream. A flow of fuel and air recirculates in turbulent eddies. The pattern of recirculatory flow is relatively stable. Between a location of reverse flow and normal flow there is a continuous gradient of fuel-air mixture flow values, including many locations where the flow rate exactly matches the burn rate, or flame speed. These locations are where the flame is anchored. To either side of the location where the flame speed matches the fuel-air flow velocity, the fuel-air flow rate is too fast or too slow or the amount of entrained air results in a fuel mixture that is too rich or too lean to support continuous burn. If the flame speed is altered by outside influences such as air from outside the fuel stream or fluctuations in the fuel-air mixture stream, the burn point can move to an adjacent location where the fuel-air mixture stream velocity will be correct for the new flame speed value. Thus conventionally, recirculation has been a necessary condition to stabilize the flame in burners.

Typically recirculation is created by placing a block in the path of the fuel mixture flow and/or by creating fuel mixture swirl. Swirl is created by introducing air streams that are in a plane perpendicular to the fuel mixture flow and tangential to the burner body, which is usually cylindrical. The swirl jets deliver a mass of air sufficient to create turbulence and recirculation zones in the central region of the fuel mixture stream where the flame will burn. Swirl is conventionally represented by the swirl number, S, which can be conveniently obtained from the burner geometry and mass flow rate by, $$S=\frac{\pi r_o R}{A_t}\quad\frac{m\theta^2}{(m\theta+m_A)^2}$$

where $r_o$ is the radius of the tangential inlet, R is the radius of the burner, $A_t$ is the total area of the tangential air inlets, and $m\theta$ and $m_A$ are the tangential and axial mass flow rates respectively. Typically the swirl number is between 4 and 20 in a conventional practical burner, where the swirl must always be great enough to induce recirculation.

Most currently available commercial burners operate in the so-called diffusion flame mode. Recirculation entrains air from the surrounds into the fuel mixture to create a fuel-air mixture that will burn. The fuel jet that is used in a typical commercial burner does not contain oxygen. This provides a safety feature in that the fuel supply will not burn if flashback occurs but it has several disadvantages as well because it requires strong swirl and fuel rich recirculation.

Conventional swirl and recirculation burners burn in a fuel-rich condition in order to set up stable recirculation zones, anchor the flame, and achieve adequate air entrainment for fuel-air mixing. If the fuel-air mixture becomes lean, the flame may blow out. Under lean conditions the flame temperature and flame speed are lower and the flame blows off too easily to be practical. Operating burners under continually fuel-rich conditions not only wastes fuel, it results in pollution.

Gas-fired furnaces are used in a wide variety of large and small applications for heating, power generation and incineration. Most of the current furnaces operate in the non-premixed and partially premixed mode. The flame temperature is controlled by molecular diffusion of air into fuel coupled with turbulence transport. Consequently, the production of pollutants, which is a strong function of the flame temperature, is very difficult to control. One commonly used flame stabilization method is strong swirl found in many turbines and furnaces. The most distinct feature of strong swirl furnaces is the large recirculation or toroidal vortex zone which engulfs the flame and dominates the flow within the combustion chamber. The large recirculation zone entrains air which is necessary for burn, but the burn is incomplete, the fuel mixture is rich, the flame is hot, and there is an undesirably high level of $NO_x$ emission.

Using entirely premixed-fuel, flame temperature can be controlled by varying the equivalence ratio. For lean flames, with temperatures below 1800 Kelvin, production of $NO_x$ is significantly lower than for near stoichiometric flames. Designing clean, reliable and safe premixed furnace burner suffers from the potentially explosive character of the premixed reactants and difficulty in stabilizing flames of lean fuel, especially in high speed turbulent flows typical of those found in most medium to large furnaces. It would be extremely desirable to have a technology where flames of lean premixed fuel and air burned stably and safely.

$NO_x$ is formed via three reaction paths in flames. "Thermal $NO_x$" is formed by the direct reaction between nitrogen gas, $N_2$, and oxygen gas, $O_2$. This is sometimes referred to as the Zeldovich mechanism. "Prompt $NO_x$" is produced by interaction between intermediate carbon nitrogen (CN) molecules. The reactions are temperature sensitive and occur during the preheat phase of flame combustion. Flames with short preheat intervals produce lower concentrations of prompt $NO_x$ than flames with longer preheat intervals. Recirculation and preheating of reactants increases prompt $NO_x$ production. "Fuel $NO_x$" is produced when nitrogen-containing impurities in the fuel react with oxygen.

It would be desirable to burn a flame as lean as possible, that is, mixing as much air with the fuel as possible so that thermal $NO_x$ emission is minimized. It would be further desirable to burn a flame without recirculation and preheat zones thus minimizing production of prompt $NO_x$. It would be additionally desirable to establish a lean flame that did not require recirculation and that burned a clean fuel such as natural gas.

There is a need for a burner and method to burn a lean fuel-air mixture with a stable flame. It would be particularly desirable for the lean fuel-air burner to emit lower $NO_x$ concentrations than existing burners. It would be further desirable for the lean fuel-air burner to burn with a flame configuration that allows for efficient fuel consumption. It would be yet more desirable to have a lean fuel-air-mixture burner that produced a flame shape efficient for heat transfer.

DESCRIPTION OF THE INVENTION

Definitions

Diffusion burner: a burner in which fuel is injected directly into the burner and combustion occurs simultaneously with the mixing of air into the fuel.

Flashback: The circumstance in which the flame front burns back to the exit port of the fuel line from the flame stabilization point.

Fuel mixture: The mixture of one or more types of fuel.

Fuel-air mixture: The mixture of one or more types of fuel combined with oxygen-containing fluid such as air, where said mixture provides the reactants for combustion.

Premixed burner: A burner in which the fuel is mixed with air or oxygen-containing fluid before entering the flame zone.

Flame speed: The rate at which flame reactants are consumed in combustion.

Blowout: The circumstance in which the fuel mixture velocity exceeds the flame speed and thus extinguishes the flame.

Equivalence ratio: Measures the departure from a stoichiometric burn reaction. It is the ratio of fuel to stoichiometric oxygen divided by the ratio of fuel to actually available oxygen. It is designated by $\phi$. For example, for methane, $$\phi = \frac{[CH_4]/[O_2]_{Actual}}{[CH_4]/[O_2]_{Stoichiometric}},$$

where stoichiometric conditions are $CH_4=2[O_2] \rightarrow CO_2+2H_2O$

Fuel rich conditions: $\phi>1$

Fuel lean conditions: $\phi<1$

Flame temperature: The temperature of the hottest part of the flame.

Axial flow: Flow that is parallel to the long axis of the burner body.

Radial flow: Flow that is perpendicular to the long axis of the burner body.

Rotational flow: Flow that rotates around the long axis of the burner body, in a plane normal to the axial fuel flow, also called tangential velocity.

Recirculation: Flow that changes from parallel to antiparallel to the long axis of the burner body, also called flow reversal.

1. SUMMARY OF THE INVENTION

The present invention is a gas fuel burner and method of burning gas fuel that provides a stable flame under ultralean fuel conditions. The mechanical design avoids complex structures that could clog or create operating difficulties. Using the present invention, it is not necessary to anchor the flame with a blunt body. The flame has a flat shape that is efficient for heat transfer. The inventive burner and method scale easily to the size needed to deliver the requisite power, depending upon the system requirements in which it is being used. The ultralean fuel burner and method of the present invention burns with a stable, adiabatic, efficient flame and in addition, emits much lower concentrations of $NO_x$ than currently available burners.

The method of the present invention uses a premixed fuel-air mixture that is swirled gently by low swirl jets of air introduced tangentially, upstream of the exit port of the fuel-air nozzle. The low swirl creates a stable flow pattern that anchors the flame. As the fuel-air mixture progresses downstream of the swirl jets, the diameter of the flow stream increases. The cross-section of the fuel-air stream increases with a concomitant decrease in the axial flow velocity of the fuel-air mixture, as governed by the Bernoulli equation. The progressive decrease in the axial velocity of the fuel-air mixture allows the flame to locate stably at the point where the flame speed matches the flow rate of the fuel-air mixture without recirculation. Because the fuel-air mixture is weakly swirling only at the outside edges of the burn zone, complete burning is possible and $NO_x$ emissions are minimized.

The parameters of power output, flow speed, flame temperature, flame speed, flame location, and flame shape can be easily adjusted in the present invention by modifying the fuel-air mixture velocity, swirl jet intensity, and/or equivalence ratio.

2. GENERAL DESCRIPTION OF THE INVENTION

The object of the present invention is to burn an ultralean mixture of fuel and air with stable flame. It is a further object of the invention to provide a method to burn a fuel-air mixture with high efficiency. It is yet another object of the inventive burner and method to emit fewer oxides of nitrogen than current burners do. It is yet another object of the invention to provide a method of burning fuel that scales easily in size and power. Yet another object of the present invention is burner method that adjusts easily between lean and rich fuel conditions. Still another object of the invention is to provide a mechanically simple and trouble free burner configuration. An additional object of the invention is to provide a flat flame that transfers heat efficiently to another object, for example a heat exchanger, water heater, or furnace. An even further object of the invention is to provide a research burner and method of burning to enable research and study of combustion, flame dynamics, and fundamental properties of premixed turbulent and laminar flames.

Figure 1:
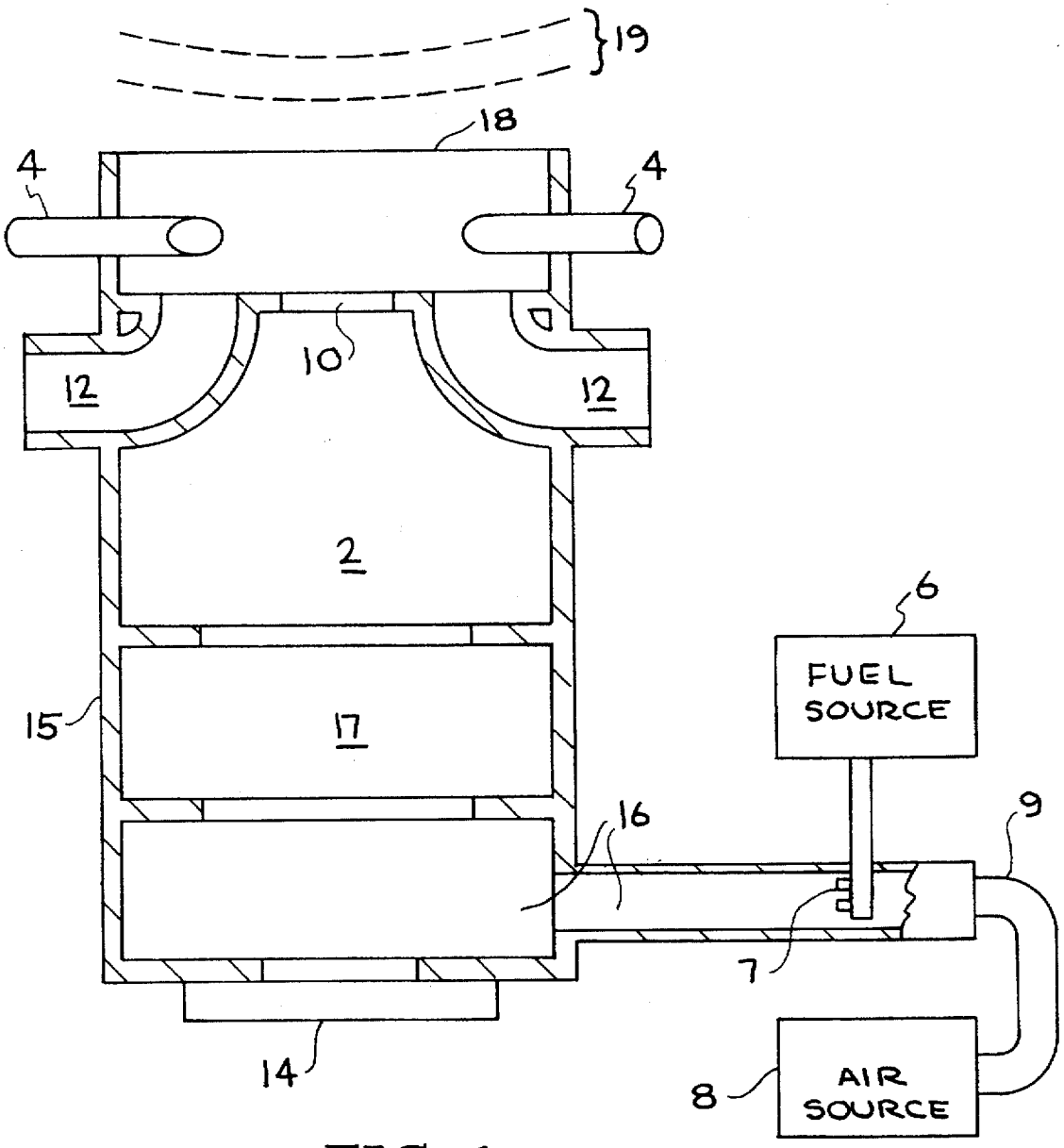
FIG. 1: A laboratory gas fuel burner from which measurements were taken on the present invention, having fuel source 6, fuel line 7, forced air source 8, forced air line 9, mixing zone 16, pressure release 14, burner body 15, optional settling chamber 17, and swirling means 4.

The present invention comprises a method of burning fuel in a swirl burner such as the one illustrated in FIG. 1. The burner comprises a burner body 15 having a fuel source 6 (containing its own fuel valve) and air source 8 (containing its own air valve). The fuel line 7 and air line 9 project into a fuel-air mixing zone 16 in the lower portion of the burner body. The fuel is comprised of any of a variety of materials or mixtures including methane, natural gas, hydrogen gas, ethylene, propane, and gaseous hydrocarbons. An optional settling chamber 17 is used in research apparatus. Optionally a fuel-air mixture nozzle can be formed by reducing the cross-sectional area of the mixing zone immediately upstream of the swirlers 4. Optional air co-flow inlets 12 are located in an annulus around the optional nozzle. Positioned downstream of the mixing zone are tangential air jets 4 which comprise a means for introducing swirl to the fuel-air flow stream. A burner exit port 18 is located downstream of the air jets. The flame zone 19 is in an open region immediately downstream of the burner exit port.

In operation, fuel is introduced into the mixing zone via the fuel line 7 and air is introduced via the air line 9. The fuel and gas mixture has an equivalence ratio between the lean flammability limit and about 2.0. More preferably the equivalence ratio is between the lean flammability limit and about 1.0. The resulting mixed fuel-air mixture moves through the optional settling chamber where turbulence is homogenized with use of flow homogenizing screens if the burner is used for research purposes. Optionally a co-flow of air is introduced via co-flow inlet ports 12. The fuel-air stream then flows by the swirlers where rotational flow is imparted to an annulus region immediately inside the perimeter of the fuel-air stream. Upon emerging from the exit port 18 of the burner body 15, the diameter of the flow steam diameter increases thereby causing the axial velocity of the flow stream to decrease. The flame zone 19 establishes itself where the axial velocity equals the flame speed.

The present invention stabilizes the burner flame using a method that is entirely different than previous burners. Previous burners caused the fuel air mixture to recirculate in a strong stable pattern of eddy currents so that somewhere within the circulating flow there existed flow of the correct velocity for stable burn. This recirculation pattern was caused by the geometry of the burner and fuel nozzle and/or by introducing tangential air streams into the fuel flow to cause such violent swirling of the fuel and fuel-air mixture that recirculation patterns were set up. These recirculation patterns are typically in a plane parallel to the axial flow direction of the fuel-air mixture. The number of regions in the flame with conditions for optimum burning was only a portion of the flame volume.

In contrast, the present invention does not require violent agitation of the fuel or fuel-air mixture to set up recirculation zones. Instead the present invention is a burner design that causes a stream of premixed fuel-air mixture to diverge and expand in cross-sectional area as it travels from the exit port of the mixing zone. As the cross-sectional area of the fuel-air mixture stream expands, the overall axial flow velocity decreases steadily. This produces a very stable situation for the flame to maintain itself at the position where fuel-air flow velocity equals the flame speed. Flame blow-off and flashback are effectively prevented because the flow velocity upstream is higher than the flame speed and the flow velocity downstream is slower. If the flame starts to blow off, it encounters slower moving fuel-air mixture and stabilizes. If the flame starts to burn back toward the burner, it encounters more rapidly flowing fuel-air and stabilizes. This is the reason why very lean flames can propagate stably in this burner.

This invention causes the fuel-air mixture stream to diverge and expand by use of a swirl design. In contrast to previous swirl designs, the swirl used in the inventive swirler is very gentle; it is far too weak to produce recirculation. The function of the swirler in the present invention is to cause the edges of the fuel-air mixture to rotate in a plane perpendicular to the axial flow direction of the fuel-air mixture, with tangential velocity, W. This imparts centrifugal force to the outside edge of the fuel-air stream and causes the outer portion of the stream to expand as the stream leaves the swirlers. The expanding outer edges pull the non-rotating interior portion of the stream out radially, thus increasing the diameter and slowing the axial velocity. For example, the swirl number for the present invention is typically about 0.05 to about 0.1 and can range from values as low as about 0.9 to as large as about 3.0. Preferably the swirl number range is between 0.03 and 2.0. More preferably the swirl number range is between about 0.03 and about 1.0. This contrasts with swirl numbers of 4.0 to 5.0 for existing conventional swirl burners. Tangential velocity (or rotational velocity) measurements were taken a distance of 10 mm downstream of the mixing zone exit port. In the region of the flow stream measured along the flow-stream radius, r, from $r \approx 0$ to $r \approx 30$ mm, the rotational .velocity of the fuel-air mixture was measured to be about zero meters/sec. That is, the inner core of the fuel-air stream was not rotating. At $r \approx 50$ mm, the rotational velocity increased to values ranging from about 0.5 meters/sec to about 2.5 meters/sec. That is, the periphery of the fuel-air mixture flow stream was rotating.

The present invention uses a flow stream of premixed fuel and air 2. There are many ways of achieving the premixture of fuel and air; FIG. 1 shows one possible configuration comprising a fuel mixture inlet 6, and an air inlet 8, which deliver fuel and air to a mixing zone 16. In some embodiments the flow stream was surrounded by a co-flow of air 12 but this co-flow was later found to be unnecessary. Swirl was generated by tangential air injection from ports 4 mounted tangentially to the circumference of the burner body. The swirlers are located downstream of the mixing zone 16 enclosed by a burner body, 15. The fuel-air mixture was forced through the center nozzle 10, which was 50 millimeters in diameter but is not so limited. The ratio between the volume of air injection and the volume of the total flow through the nozzle, 10, is represented by the swirl number, S.

Under conditions of weak swirl a freely propagating flame can be maintained for a wide range of fuel-air equivalence ratios from very fuel lean to fuel rich. The leanest stable burning condition found for a methane-air mixture was about 56% of the stoichiometric reaction. Other burners equipped with flame stabilizers or pilot flames such as those currently used in conventional commercial furnaces are not capable of supporting stable combustion under this ultra lean condition.

Weak swirl was found to stabilize a freely propagating yet steady flame at a distance above the burner exit. The flame flow field was not influenced by physical boundaries as in the cases of stagnation point flames, rod-stabilized v-flames, and Bunsen flames. The flame zone 19 and its properties were not affected by shear associated with swirl. The flame produced by the inventive method is the closest approximation, to date, to the planar one-dimensional premixed turbulent flame of many theoretical models. The flame of the inventive method stabilized at a much wider range of equivalence ratios than other flames. Among other uses, these qualities make the inventive method of flame burning particularly useful for experimental research on premixed turbulent flame propagation (Freely propagating open premixed turbulent flames stabilized by swirl, by C. K. Chan, K. S. Lau, W. K. Chin, and R. K. Cheng, LBL Report #31581, incorporated herein by reference). The flame of currently available flat-flame burners that are useful for research, sit about several millimeters from a matrix of ceramic honeycomb, a configuration that is not convenient for laser diagnostic interrogation. The close proximity to the honeycomb also prevents the flame from burning adiabatically. The method of the present invention produces a flat adiabatic flame that is convenient for laser interrogation.

When the inventive burner and method is used for research purposes, a settling chamber module 17 is interposed between the mixing zone and the swirlers. The settling chamber contains 2 or 3 thin wire screens with glass beads of about 1 cm diameter. The settling chamber breaks up flow inhomogeneities and homogenizes the turbulence so the flow can be accurately characterized in a research purposes.

The contraction region shown downstream of the settling chamber 17 and upstream of the nozzle 10 in FIG. 1, is not necessary but can aid in characterizing the flow for research purposes.

Figure 1A:
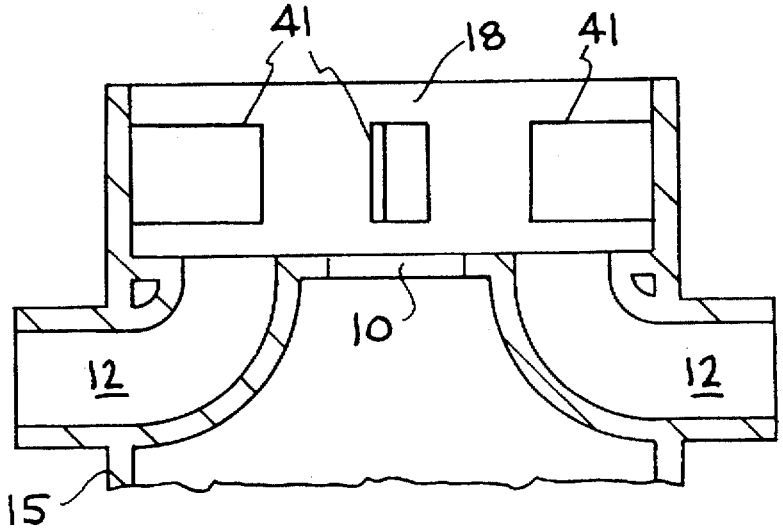
FIG. 1A: illustrates a side view of swirling means comprising vanes.
Figure 1B:
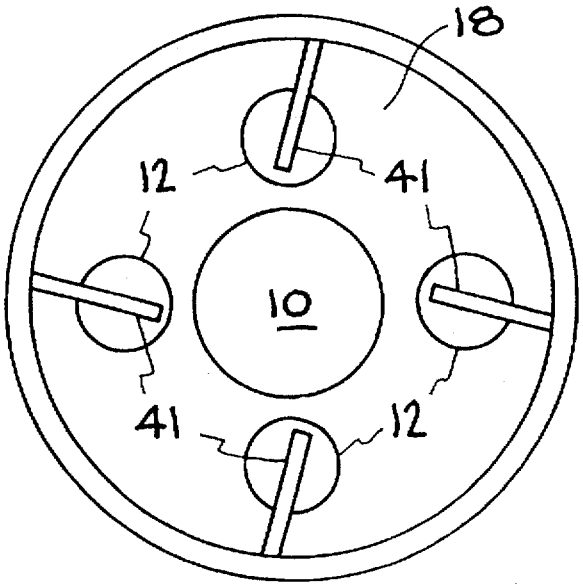
FIG. 1B: illustrates a top view of swirling means comprising vanes.

One key to the design of the ultra lean premixed swirl burning method of the present invention was to produce and control flow divergence and flame speed for different fuels at different fuel-air equivalence ratios and flow conditions. Air injection is only one of the many different means to generate swirl. Swirl vanes and other mechanical devices can also produce the necessary flow divergence. FIG. 1A shows a side-view schematic illustration of the use of vanes 41 for swirling means in addition to or instead of air jets; they may vary in number according to circumstance and burner configuration. FIG. 1B shows a top-view schematic illustration of vanes placed in the burner to create swirl. The vanes are optionally fixed in position or hinged where they join the burner body, and using techniques well known in the art may be constructed to have a fixed pitch or variable pitch as the as the configuration of the swirl burner in which they are used dictates.

One prototype of the inventive method of burning fuel was operated at up to 50 kilowatts per hour when used with methane. This energy rating is close to that of a typical home heating furnace. Scaling up or down for other energy requirements is easily achieved by one of ordinary skill in the art by using flow nozzles of ,different sizes or by altering the number and size of swirlers.

Flame flashback is very unlikely in the present invention, but for safety reasons, a pressure release safety mechanism 14 was attached to the mixing zone. Many other safety mechanisms to protect against the unlikely event of flashback to the fuel line are also possible.

In the apparatus illustrated in FIG. 1, the exit port of the burner 18 was about 100 mm in diameter. The tangential air inlets 4, used to create swirl, were located 75 mm upstream of the burner exit port 18. The flame zone 19 was located downstream from the exit port. The distance between the flame zone and the exit port varied with the exit velocity of the fuel-air mixture, the amount of swirling, and the composition of fuel, among other parameters.

Figure 2:
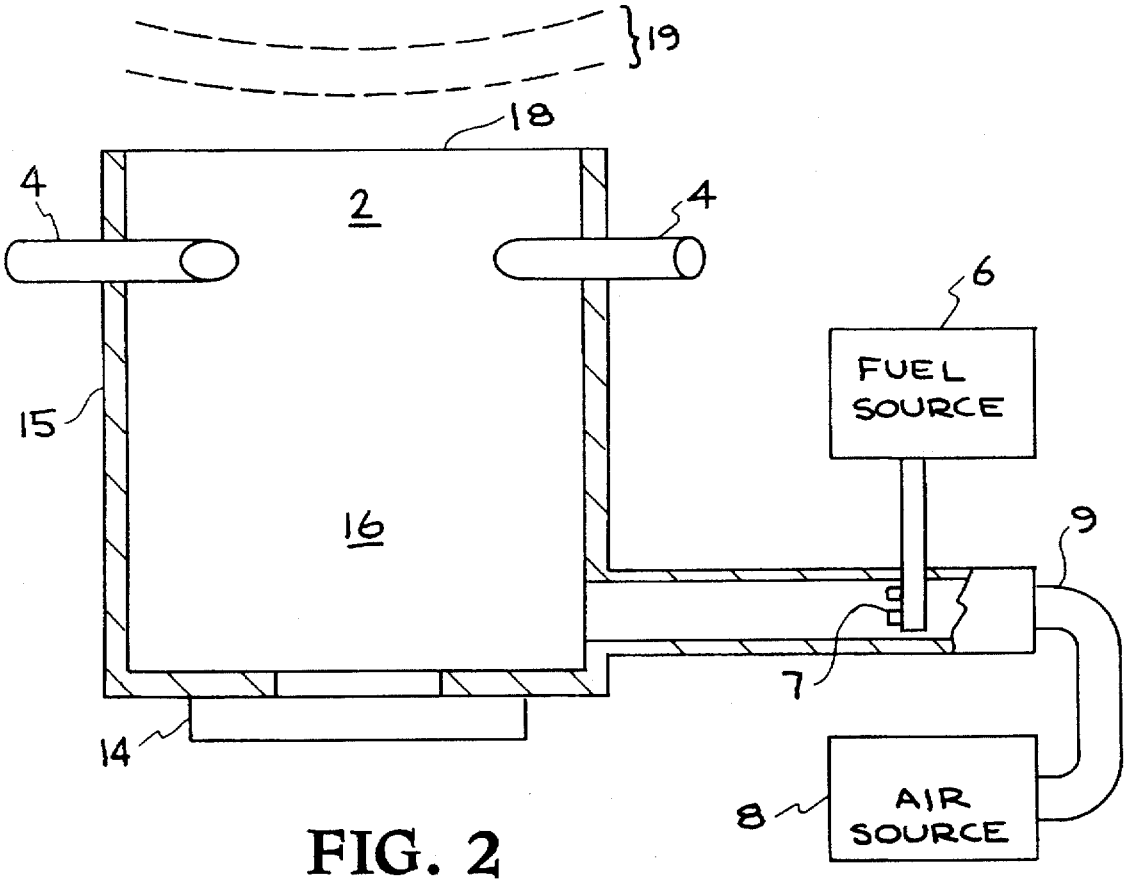
FIG. 2: Illustrates simple design of open low-swirl burner without optional features unique to required for the research burner shown in FIG. 1.

FIG. 2 illustrates the low swirl burner without most of the optional features normally used for research purposes. This simple open-flame low-swirl burner design is comprised simply of a fuel source 6 and fuel line 7, an oxygen-containing gas source 8 and said gas line 9, a mixing zone 16 located within the burner body 15, a swirling means such as tangential air jets 4, located 25 downstream of the mixing zone, and a burner exit port 18. When the swirling fuel and gas mixture emerges from the burner, a stable flame or combustion zone will be established downstream 19. The combustion zone operates between atmospheric pressure and about 15 atmospheres pressure. It would be more preferable to operate the combustion zone between atmospheric pressure and about 10 atmospheres pressure. Even more preferably, the combustion zone would be operated between atmospheric pressure and about 5 atmospheres pressure.

Figure 3:
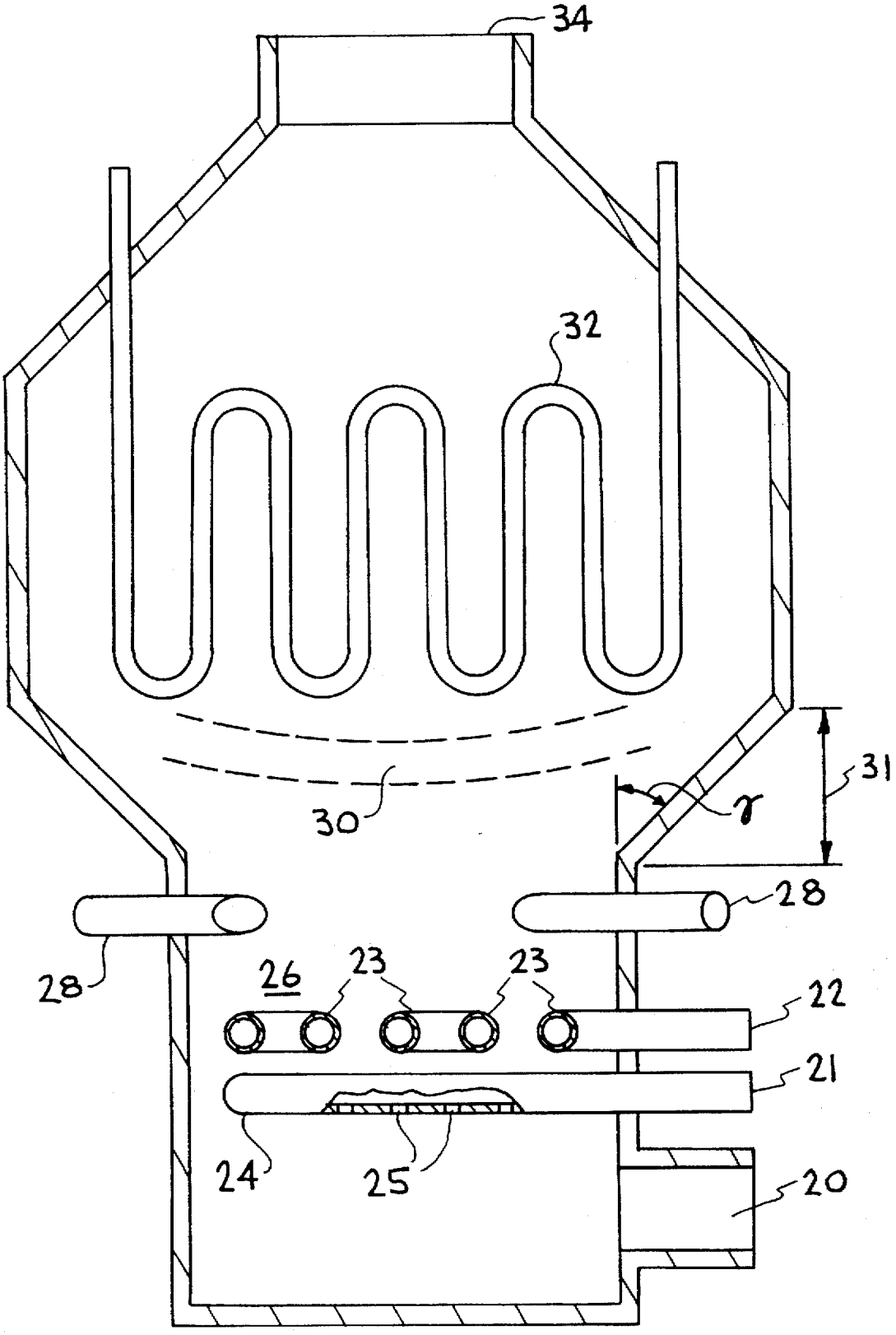
FIG. 3: Illustrates application of the inventive method and burner to a furnace.

FIG. 3 illustrates application of the inventive method and burner to an enclosed burner, such as would be used in a furnace. Air is introduced through the air port 20. Fuel is introduced through fuel ports 21 and 22. The fuel ports connect to serpentine shaped fuel injection lines 23 and 24 located in the fuel-air mixing zone 26. The grids 23 and 24 are orthogonal to one another and inject fuel, through fuel outlet holes 25, in an upstream direction, toward the bottom of the chamber. The rising air mixes with the fuel as the mixture enters the mixing zone 26. A swirling device 28 is located downstream of the mixing zone 26. Tangential air injection ports are illustrated in FIG. 3 but many other methods of swirling may be employed.

Immediately downstream of the swirlers the enclosure widens with angle $\gamma$. This angle must be at least wide enough to allow the fuel-air mixture to enlarge unhindered in diameter as it travels to the flame zone (also referred to as the combustion zone) 30. The flame zone is located within the expansion zone 31 of the enclosure. Located downstream of the flame zone are heat exchange mechanisms 32 and an exhaust vent 34.

The primary role of turbulence in the combustion chamber is to increase the burning rate. The turbulence found in most conventional furnaces is known as shear turbulence. It is generated by shear forces between two flows of different velocities and/or directions. Examples of shear turbulence can be found in jet flames common in non-premixed or partially premixed furnaces. The jet velocity is substantially higher than the surrounding air. Shear turbulence generated by the jet entrains air which mixes and burns with the fuel. Shear turbulence promotes mixing between hot burning gases and the cold fuel-air mixture, which in turn affects NOx emissions. The turbulence in the present invention has no mean shear; the velocity is uniform across the burner.

The burning rate as expressed in terms of flame speed increases with increasing turbulence intensity. Because turbulence occurs naturally, existing turbulence in a system using the present invention is sufficient to sustain satisfactory operating of the weak-swirl furnace. Using the method of the present invention the power output can be increased by increasing turbulence intensity, without increasing system size. Turbulence scales and intensities are varied by use of a grid or perforated plates. The grid spacing and hole size are varied as needed. The grid or perforated plate additionally serves as a flame arrestor.

Turbulence generators are used, in general, to create the turbulence necessary to achieve fuel-air mixing. A homogeneous mixture of fuel and air is essential for all premixed-fuel furnaces. Mixing without turbulence usually requires a relatively long time and the mixing zone can be as long as 2 meters. Shortening of the mixing zone is desirable because it reduces the size of the furnace and also minimizes the volume of premixed reactants, which is important for safety reasons. In the present invention, the burner design incorporates the turbulence generator into the fuel-air inlet lines. Thus the present invention minimizes mixing time and the length of the mixing zone.

Figure 4:
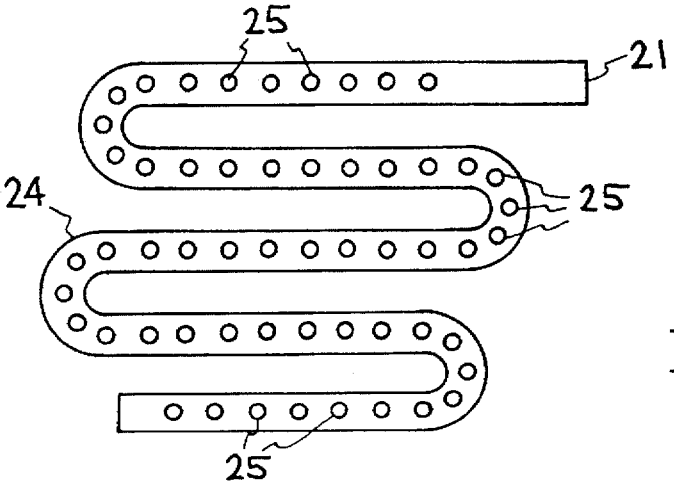
FIG. 4: Bottom view of the serpentine fuel line 24 in the enclosed burner illustrated in FIG. 3.

FIG. 4 illustrates the inventive sepentine fuel lines 24 that act as turbulence generators and deliver fuel to the burner body through a plurality of openings 25 in the fuel line. Use of an orthogonally oriented pair of such fuel lines creates a rectilinear grid geometry. Using a fuel or air line as turbulence generator results in a minimal length and volume of the mixing zone.

There are many possible mechanisms, other than tangential air injectors described above, by which gentle swirl can be introduced to an annulus region immediately inside the perimeter of the fuel-air flow stream. For example, placement of vanes in the annulus region immediately inside the perimeter of the fuel-air flow stream, and immediately upstream of the exit port of the burner induces gentle swirl. Several designs of vaned swirling devices are possible, including, fixed vanes, motorized rotating vanes, or they vanes that rotate from the kinetic energy of the fuel-air flow stream passing through them. The vanes are constructed with fixed pitch or variable pitch or variable pitch depending on the application.

EXAMPLE 1

The apparatus illustrated in FIG. 1 was used. The burner was supplied by a 50 mm diameter inner core of fuel-air mixture surrounded by an annular co-flow air jet of 114 mm diameter. Swirl was generated by injecting air tangentially through two tangential air inlets of 6.1 mm diameter. The tangential air inlets were located 25 mm downstream the nozzle 10 and 75 mm upstream of the burner exit port 18. As the air supply to the tangential inlets was independent of the co-flow air supply, a range of swirl numbers, $, was obtained by adjusting the tangential air flow, which was monitored by a rotameter. A turbulence grid with 5 mm grid spacing and a perforated plate with 4.76 mm diameter holes 1.8 mm apart were used to generate incident turbulence of between about 5% and about 8.5%. The turbulence generators were located just upstream of the swirlers. Table I below shows results using the weakly swirling burner.

TABLE I

| Case | Turbulence source | Fuel | Equivalence ratio $\phi$ | Swirl Number S | Max. flame crossing frequency |
|---|---|---|---|---|---|
| 1 | none | $C_2H_4$ | 0.65 | 0.07 | 20 |
| 2 | plate | $C_2H_4$ | 0.65 | 0.07 | 90 |
| 3 | plate | $CH_4$ | 0.8 | 0.08 | 120 |
| 4 | grid | $CH_4$ | 1.0 | 0.07 | 100 |

A parametric study was carried out to determine the stabilization range by varying the tangential injection rate, the co-flow rate, and the equivalence ratio, and by the use of different turbulence generators including a square grid, perforated plate, or no turbulence generator. To be compatible with the conditions of previous v-flames and stagnation point flames, the exit velocity of the flow without swirl was maintained at about 5.0 m/s equal to a Reynolds number of 40,000 based on the burner diameter. Using a $C_2H_4$-air mixture of $\phi$=0.75, it was found that varying swirl changed the position of the flame brush. Weaker swirl pushed the flame downstream; stronger swirl pulled the flame closer to the exit port of the burner. The range of swirl number, S, that supported steady turbulent flame operation was from about 0.05 to 0.38. This range is significantly lower than reported in other studies of open and enclosed swirl flames. The lean stabilization limit determined for methane-air mixtures with S=0.07 was $\phi$=0.57. This lean limit is the lowest compared to those of other laboratory flame configurations (which achieve a lean stabilization limit of about $\phi$=0.75 for methane-air mixtures). Changing the co-flow rate did not have a significant effect on the stabilization range nor on the flame shape.

The equivalence ratios noted in the table above represent very lean fuel air mixtures. In contrast, conventional burners use equivalence ratios in the range of 1 to 6.0 (Syred, N. and Beer, J. M., Combustion and Flame, 23: 143, 1974).

Figure 5:
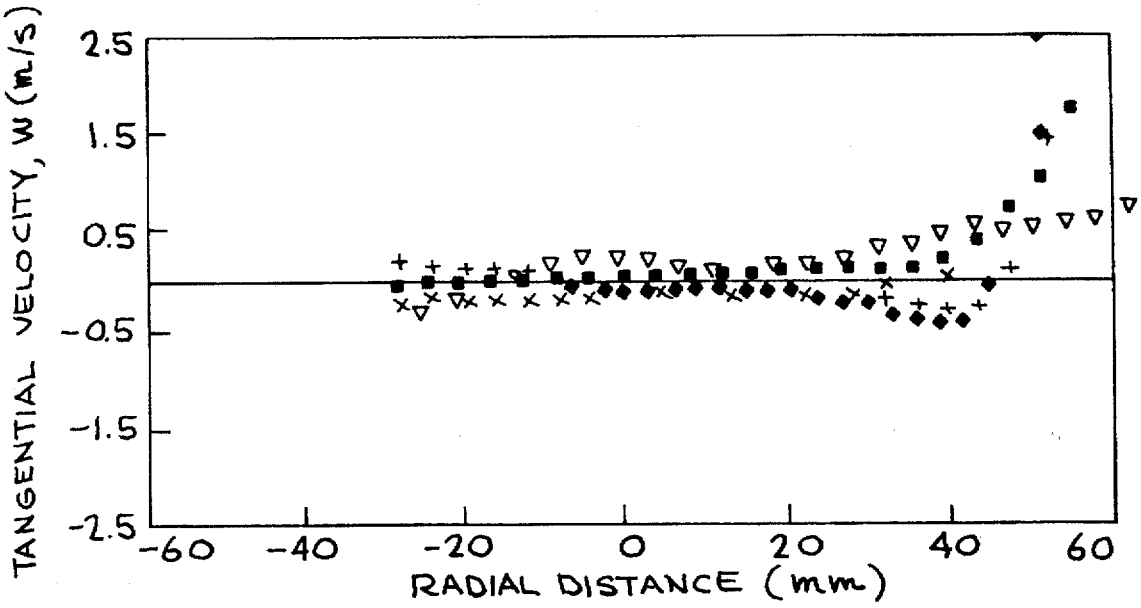
FIG. 5: shows tangential velocity measured in meters per second as a function of radial distance, in mm, from the center of the burner.

The tangential velocity was measured using laser diagnostics. FIG. 5 shows profiles of the mean tangential W(r) velocity, measured in meters per second at 10 mm above the burner exit 18 and plotted along the y axis. The radial distance from the center of the burner is plotted along the x axis. The symbols correspond to conditions listed in Table 1 as follows: Case 1 is represented by '+'; case 2 is represented by '▽'; and case 3 is represented by 'x'. The ◇ and □ symbols represent cases when no fuel was used (not shown in Table 1). The swirling motion is only significant outside the 25 mm diameter fuel/air core. Although the flame is stabilized by swirl, the tangential velocity component across the flame zone is negligible indicating that the flame zone itself is not swirling.

Figure 6:
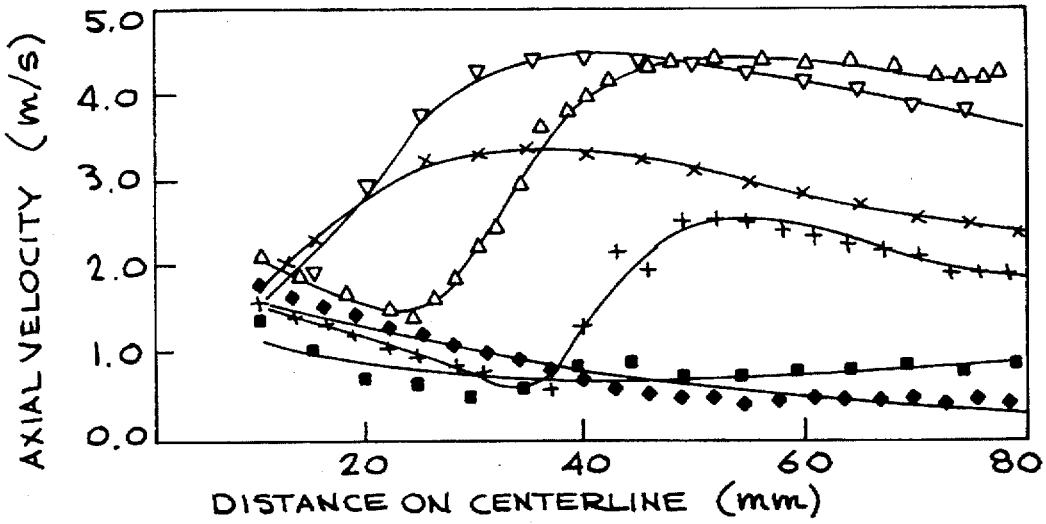
FIG. 6: shows axial velocity measured in meters per second as a function of distance along the centerline in mm.

FIG. 6 shows the centerline mean axial velocity U(x) profiles for conditions corresponding to the cases listed in Table 1. U(x) is plotted along the y axis in meters per second; distance along the centerline, measured in mm from the burner exit, is plotted along the x axis. The ◇ and □ symbols represent cases when no fuel was used (not shown in Table 1). Case 1 is represented by '+'; case 2 is represented by '▽'; case 3 is represented by 'x'; and case 4 is represented by 'Δ'. Axial velocity measurements clearly showed that recirculation was not present and therefore was not relevant to flame stabilization. The flame zones of cases 1 through 4 were marked by increases in axial velocity caused by combustion-induced acceleration. Case 3 demonstrated that a small increase in swirl drew the flame zone closer to the exit. Downstream from the flame zone the axial velocity decreased gradually. Axial velocity increased in the combustion zone in a manner characteristic of premixed turbulent flames. The changes were small compared to those observed in v-stabilized flames where the product flow accelerates or in stagnation flow stabilized flames where it decelerates ("Freely Propagating Open Premixed Turbulent Flames Stabilized by Swirl", by C. K. Chan, K. S. Lau, W. K. Chin, and R. K. Cheng, LBL Report #31581.

The flame crossing frequency, v, indicates the mean time scale of wrinkles in the flame. As shown in the table above, case 1 had the lowest $v_{max}$. Because case 1 does not use a turbulence generator its v was most likely associated with the perturbation frequency of the swirl injectors.

Figure 7A:
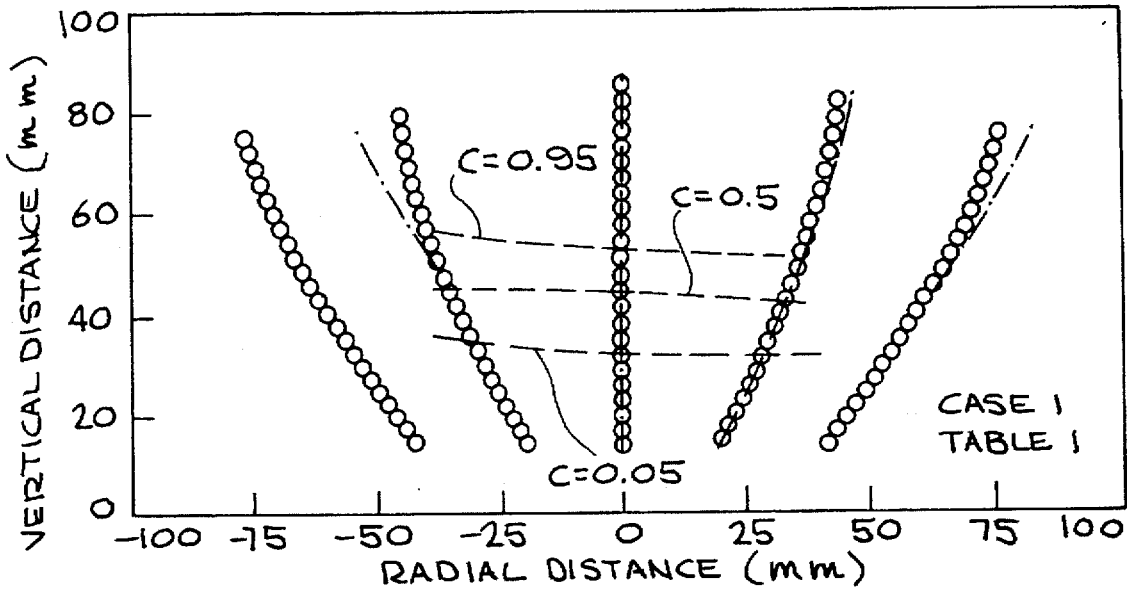
FIG. 7A:shows two-dimensional flowlines and flame boundaries for case 1 (from Table 1) and its corresponding non-combustion flow and c (completeness of burn) profile.
Figure 7B:
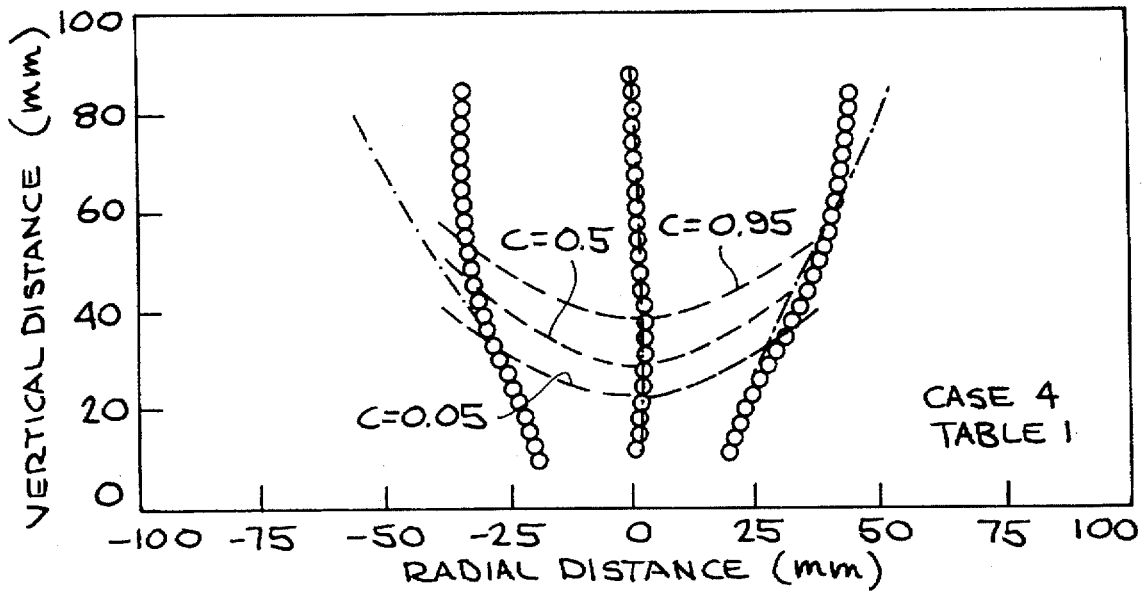
FIG. 7B: shows two-dimensional flowlines and flame boundaries for case 4 (from Table 1) and its corresponding non-combustion flow and c (completeness of burn) profile.

The two-dimensional flowlines obtained in case 1 and case 4 (i.e. with or without a plate), for both combustion and the associated non-combustion circumstances, are compared in FIGS. 7A and 7B. Flowline tracing was appropriate because there was very little effect of swirl in the flame zones and in most the surrounding co-flow. FIG. 7 also illustrates lines indicating the completeness, c, of burning of the fuel, with 1.00 representing complete burning. The c contours mark the time-averaged mean flame brush position. The planar flame brush for case 1 appeared thicker than the curved flame brush of case 4 because of bouncing. For case 1, the flowlines under combusting (chain symbol) and non-combusting (dash-dot line) circumstances were similar. For case 4, the flowlines under combusting (chain symbol) and non-combusting (dash-dot line) circumstances were less similar possibly due to asymmetry in the combustion flow and reduced divergence of combustion products. The reduced divergence is consistent with the change in mean pressure gradient generated by the higher flow velocity. Upstream of the reaction zone, the reacting and non-reacting flowline were identical. The general features of the flowlines and flame shape of case 4 and of other flames studied in the above cited reference resemble those of a stagnation point stoichiometric ethylene/air flame which was deemed as one of the closest approximations to a one-dimensional normal planar premixed turbulent flame {Cheng, R. K., Shepherd, I. G. and Talbot, L., 22nd Symposium (International) on Combustion, pg. 771, The Combustion Institute, 1988: (flame "S9"). Those cited results, however, were achievable in the stagnation flow configuration only for a single mixture. In contrast, the inventive swirl stabilized flame configuration is capable of producing similar flame flowfields under a much wider range of conditions.

The measurements show that flow divergence was the key flame stabilization mechanism for the weak swirl method of burning. The inventive weak swirl method induced radial mean pressure gradients which caused flow divergence but not recirculation. The flame stabilized itself at the position where mass fuel-air flux equaled the burning rate. Varying the swirl changed the rate of divergence and caused the flame brush to reposition itself. Although stagnation flow also stabilizes the flame by flow divergence, there are many differences between the two mechanisms. The inventive low swirl stabilized flame zone is not in physical contact with any surfaces, thus avoiding downstream heat loss or flame interaction with the plate as occurs in stagnation flow. The flow divergence is smaller in the inventive low swirl mechanism than in stagnation flow. In the inventive method, swirl is an adjustable parameter that is much more easily adjusted than stagnation plate location.

The swirl stabilized flame was freely propagating but stationary. The flame zone was easily accessible for either point or two-dimensional laser diagnostics. Flow divergence was the only inherent physical limitation of the low swirl operated burner.

EXAMPLE 2

A ThermaElectron, Model 14, $NO_x$ Chemiluminescent Analyzer was used to measure $NO_x$ emission characteristics of the weak swirl burner configured as shown in FIG. 1. The analyzer was calibrated using a 525 parts per million (ppm) NO and $NO_2$ mixture. Samples were taken from several locations in and above the flame zone using an uncooled, ⅛-inch diameter, quartz probe. Samples were transferred to the analyzer via Teflon® lines. Condensable water was removed using an ice bath.

The measurements were taken at a flow velocity of 4 meters/sec and the total flow rate of 7.85 liters/sec. For a methane-air mixture at equivalence ratio, $\phi$=0.7, $NO_x$ emissions of 7.5 ppm were measured. For a methane-air mixture at equivalence ratio of $\phi$=0.6, $NO_x$ emissions were measured at 4 ppm. For a given equivalence ratio, the emissions were constant for all sample locations.

These values are significantly below the $NO_x$ emissions values for conventional burners and burner methods. The thermal $NO_x$ emissions alone for small research burners is about 75 ppm for $\phi$=1.0 (Miller and Bowman, Prog. Combustion Science Tech., 15: 4, 287–338, 1989). Conventional commercial burners use much higher equivalence ratios than 1.0 and have considerably higher $NO_x$ emissions than those measured by Miller and Bowman.

EXAMPLE 3

A weak swirl furnace design is shown in FIG. 3. The system is entirely enclosed for safety considerations and to minimize heat loss. Confining the flame changes the turbulent flame characteristics due to the dynamic coupling between flow acceleration generated by combustion and the flow characteristics of the confinement. For a given physical setup, the builder will have to vary parameters of flame stabilization because fluid mechanics rather than physical means is used for flame stabilization.

The furnace is initially built with tangential air injector swirlers. Swirl air volume and velocity is varied until the a workable swirl number is determined. It is then desirable to convert the air swirlers to vanes that will generate the same swirl number, swirling only an annulus region immediately inside the perimeter of the fuel stream, in the closed environment and physical parameters of the furnace. Making trade-offs among these parameters will be obvious to one of ordinary skill in the art.

A fixed vane swirler is fabricated with short swirl vanes fitted to the inside wall of a cylinder having the same diameter as the burner tube. Trade-offs are made between design parameters such as number of vanes, lengths of vanes, vane cross-section and pitch. For some applications electrically driven swirler vanes are needed. Another simple design is to mount the cylindrical fixed vane swirler on bearings enabling it to rotate from the force of the fuel steam passing through.

The fuel is injected through the turbulence generator (FIG. 3) so that local high turbulence intensity promotes intense mixing. Two stages of baffles, made of parallel small metal tubes are used to inject the fuel, 21 and 22. The parallel tubing of each stage is place orthogonally to form a grid inside the mixing zone 29. The size and spacing of the fuel tubes controls the turbulence intensity. Fuel is injected through small opening on the metal tubes. The holes face upstream to create opposed stream mixing. The partially mixed fuel and air stream then flows around the tubing. Turbulence generated in the wake completes the mixing processes. In the unlikely event that flashback occurs, the flame will not propagate into the fuel line; the fuel tubes act as a flame arrestor.

The two parameters that determine the power output are the total flow rate of the fuel-air mixture and the equivalence ratios. The lower chamber (mixing zone) diameter is 5 cm and the upper chamber diameter is 10 cm. A flow velocity of 8 m/s in the mixing zone decreases to 2 m/s in the upper chamber. The swirl and turbulence intensities that stabilize the flame are determined using the same procedure described for the open burner, above. Powers from up to 100 kW are achievable. The lower power limit is comparable to that generated by a research flat flame burner. Table II below shows powers measured and calculated (in italics) using the inventive burner and burning method. A burner power output can be doubled by increasing the burner radius by a factor of 1.71.

TABLE II

| Natural Gas Flow Velocity, meters/second (Total flow rate, liters/second) | Power, kilowatts (fuel flow rate, liters/second) | | | | |
|---|---|---|---|---|---|
| | $\phi = 0.6$ | $\phi = 0.7$ | $\phi = 0.8$ | $\phi = 0.9$ | $\phi = 1.0$ |
| 2.0 | 9.25 | 10.7 | 12.09 | 13.5 | 14.8 |
| (3.9) | (0.23) | (0.27) | (0.3) | (0.34) | (0.37) |
| 4.0 | 18.5 | 21.4 | 24.2 | 27 | 30 |
| (7.85) | (0.47) | (0.54) | (0.61) | (0.68) | (0.75) |
| 6.0 | 27.8 | 32.6 | 36.3 | 40.4 | 44.5 |
| (11.78) | (0.7) | (0.81) | (0.91) | (1.02) | (1.12) |
| 8.0 | 37 | 42.7 | 48.4 | 54 | 59.3 |
| (15.7) | (0.93) | (1.08) | (1.22) | (1.36) | (1.5) |

EXAMPLE 4

Operating the inventive burner and using the inventive method in an enclosed chamber that is at a pressure greater than the atmosphere alters the dynamic coupling between fuel-air flow velocity, equivalence ratio and swirl intensity. The burner operation at pressures up to 15 atmospheres is possible with some tuning of the three above parameters.

Figure 8:
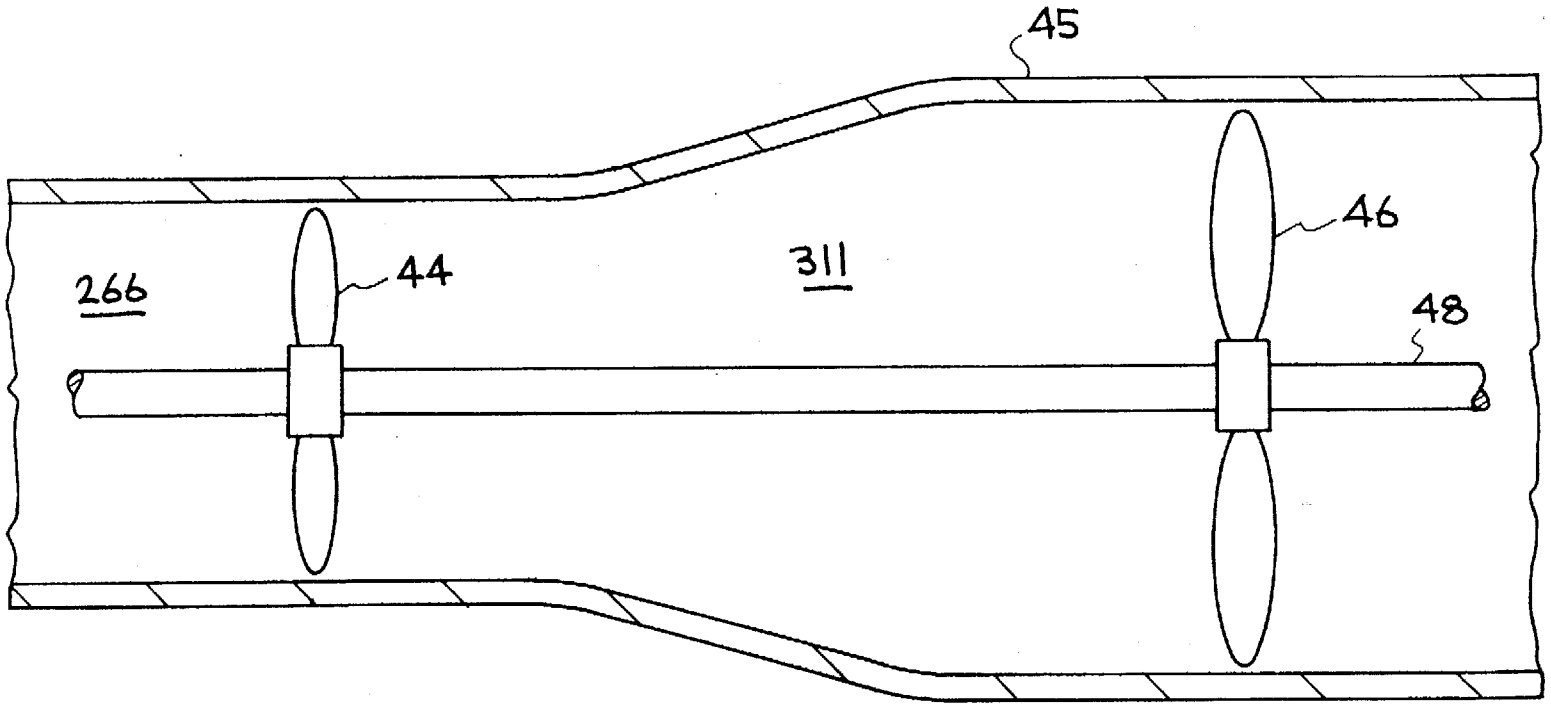
FIG. 8: illustrates the inventive swirl burner with enclosed expansion zone wherein the mechanical energy from combustion products is used to drive a turbine.

The inventive burner and burner method can also be used to drive a turbine such as in a jet engine. FIG. 8 illustrates use of the enclosed swirl burner, operating at greater than atmospheric pressure and driving a turbine. Fuel and oxygen-containing gas are mixed in a pre-mix zone, 266. A compressor 44 increases the operating pressure to between about atmospheric pressure and 15 atmospheres of pressure. The fuel mix expansion zone 311 is enclosed by the turbine body 45. Combustion products turn the turbine blades 46 and shaft 48. In this case, mechanical energy is derived from the kinetic and chemical energy of the combustion products. To couple the inventive burner and method to a turbine, the parameters of fuel-air flow velocity, equivalence ratio and swirl intensity need to be balanced for the particular geometry and physical environment.

The inventive burner and burner method is useful for many applications, including but not limited to construction of fuel efficient, low pollutant emitting furnaces (for home or industrial use), home water heaters, industrial water heaters, stove burners, retrofitting of conventional furnaces, power generation, waste incineration, jet propulsion, combustion research, and other applications where burners are used.

The description of illustrative embodiments and best modes of the present invention is not intended to limit the scope of the invention. Various modifications, alternative constructions and equivalents may be employed without departing from the true spirit and scope of the appended claims.

I claim:

1. A method of burning fuel efficiently and with minimal emission of pollutants comprising, a) injecting fuel continuously into a mixing zone;

b) injecting an oxygen-containing gas continuously into said mixing zone to produce a fuel and gas mixture which flows in a stream toward an exit;

c) swirling the resulting fuel and gas mixture downstream of said mixing zone using swirling means with sufficient force to impart rotational motion to the periphery of, and in a plane normal to the flow of, said fuel and gas stream, but without inducing recirculation therein;

d) burning said swirling mixture downstream of the mixing zone and swirling means.

2. The method of claim 1 wherein the fuel is selected or mixed from the group comprised of methane, natural gas, hydrogen gas, ethylene, propane, or gaseous hydrocarbons.

3. The method of claim 1 wherein the mixing zone is cylindrical.

4. The method of claim 1 wherein the oxygen-containing gas is air.

5. The method of claim 1 wherein said fuel and gas mixture has an equivalence ratio between about the lean flammability limit and about 2.0.

6. The method of claim 5 wherein said fuel and gas mixture has an equivalence ratio between about the lean flammability limit and about 1.0.

7. The method of claim 1 wherein the swirling is characterized by a swirl number, S, between about 0.01 and about 3.0

8. The method of claim 7 wherein the swirling is characterized by a swirl number, S, between about 0.03 and about 2.0.

9. The method of claim 8 wherein the swirling is characterized by a swirl number, S, between about 0.03 and about 1.0.

10. The method of claim 1 wherein the swirling is provided by injecting air tangential to the circumference of the mixing zone through air injectors.

11. The method of claim 1 wherein the swirling is provided by locating vanes in an annulus region immediately inside the perimeter of said fuel and gas mixture flow stream.

12. The method of claim 11 wherein the vanes are fixed.

13. The method of claim 11 wherein the vanes are movable.

14. The method of claim 11 wherein the pitch of the vanes is fixed.

15. The method of claim 11 wherein the pitch of the vanes is variable.

16. The method of claim 11 wherein the vanes are motorized.

17. The method of claim 1 wherein said swirling fuel and gas stream is expanded into an enclosed expansion zone containing the flame combustion zone.

18. The method of claim 17 wherein the heat generated by burning said fuel and gas mixture is conveyed through a heat exchanger to a heating apparatus.

19. The method of claim 1 wherein the fuel injection means generates turbulence.

20. The method of claim 19 wherein the fuel is injected in an upstream direction from a plurality of holes in a serpentine-shaped fuel line.

21. The method of claim 20 wherein the fuel is injected in an upstream direction from a plurality of holes in two orthogonally oriented serpentine shaped fuel lines which together form a grid.

22. The method of claim 21 wherein the fuel is injected in an upstream direction from a plurality of pairs of orthogonally oriented serpentine shaped fuel lines.

23. The method of claim 19 wherein the oxygen-containing gas mixture is introduced upstream of the fuel.

24. A burner comprising, a) a fuel source;

b) a fuel line connected to said fuel source;

c) an oxygen-containing gas source;

d) an oxygen-containing gas line connected to said oxygen-containing gas source;

e) a mixing zone in which said fuel line and said gas line open;

f) a swirl generator for generating weak swirl in said fuel and gas mixture, located downstream of the mixing zone; and g) a combustion flame zone located in an expansion zone downstream of the mixing zone.

25. The burner of claim 24 wherein the position and shape of the fuel line located within the gas line generates turbulence.

26. The fuel line of claim 25 shaped in sepentine with a plurality of fuel holes pointing in the upstream direction.

27. The fuel line of claim 26 formed into a pair of orthogonally oriented grid-shaped fuel lines with a plurality of fuel holes pointing in the upstream direction.

28. The burner of claim 24 wherein the oxygen-containing gas line is positioned upstream of the fuel line.

29. The burner of claim 24 wherein the mixing zone is cylindrical.

30. The burner of claim 24 wherein the swirling means imparts swirl characterized by a swirl number S, between about 0.01 and about 3.0.

31. The burner of claim 24 wherein the swirling means comprise air jets positioned tangentially to a circumference of the mixing zone at the downstream end of the mixing zone.

32. The burner of claim 24 wherein the swirling means comprise vanes located in an annulus region immediately inside a perimeter of said fuel and gas mixture, downstream from the mixing zone.

33. The swirling means of claim 32 wherein the vanes are fixed.

34. The swirling means of claim 32 wherein the vanes are movable.

35. The swirling means of claim 32 wherein the pitch of the vanes is fixed.

36. The swirling means of claim 32 wherein the pitch of the vanes is variable.

37. The burner of claim 24 wherein the expansion zone is enclosed.

38. The burner of claim 24 wherein the expansion zone forms an angle with the burner body such that expansion of said fuel and gas occurs unhindered.

39. The burner of claim 37 wherein the expansion zone is attached to heat exchanger housing.

40. The burner of claim 39 wherein the heat generated from said combustion is transferred through a heat exchanger to a water heater.

41. The burner of claim 39 wherein the heat generated from said combustion is transferred through a heat exchanger to a furnace.

42. The burner of claim 37 wherein mechanical energy is derived from the combustion products.

43. The burner of claim 42 wherein the mechanical energy is used to drive a turbine.

44. The burner of claim 37 wherein the combustion zone is under pressure between atmospheric pressure and 15 atmospheres.

45. The burner of claim 44 wherein the combustion zone is under pressure between atmospheric pressure and 10 atmospheres.

46. The burner of claim 45 wherein the combustion zone is under pressure between atmospheric pressure and 5 atmospheres.

47. The burner of claim 24 wherein a safety device is attached to the mixing zone to prevent accidental ignition of the premixed fuel or of the fuel in the fuel line.

* * * * *